US007633333B2

(12) United States Patent
Ma

(10) Patent No.: US 7,633,333 B2
(45) Date of Patent: Dec. 15, 2009

(54) SYSTEMS, APPARATUS AND METHODS RELATING TO BANDGAP CIRCUITS

(75) Inventor: Fan Yung Ma, Singapore (SG)

(73) Assignee: Infineon Technologies AG, Munich (DE)

( * ) Notice: Subject to any disclaimer, the term of this patent is extended or adjusted under 35 U.S.C. 154(b) by 74 days.

(21) Appl. No.: 11/600,580

(22) Filed: Nov. 16, 2006

(65) Prior Publication Data

US 2008/0116875 A1 May 22, 2008

(51) Int. Cl.
*G05F 1/10* (2006.01)
*G05F 3/02* (2006.01)

(52) U.S. Cl. ..... 327/539; 327/538; 327/543; 323/313

(58) Field of Classification Search ..... 327/538, 327/539, 543; 323/313
See application file for complete search history.

(56) References Cited

U.S. PATENT DOCUMENTS 4,673,866 A * 6/1987 Masuda ..... 323/313
5,773,967 A 6/1998 Tenten
6,147,908 A * 11/2000 Abugharbieh et al. .... 365/185.2
6,859,156 B2 2/2005 May et al.
6,956,413 B2 * 10/2005 Bailey ..... 327/131
7,215,183 B2 * 5/2007 Nakada ..... 327/539
2005/0127987 A1 * 6/2005 Sato et al. ..... 327/539
2005/0285666 A1 * 12/2005 Garlapati et al. ..... 327/539
2007/0182477 A1 * 8/2007 Kim ..... 327/539
2007/0296392 A1 * 12/2007 Chen et al. ..... 323/313

FOREIGN PATENT DOCUMENTS

DE 44 39 707 A1 5/1996

OTHER PUBLICATIONS

Banba, H.; Shiga, H.; Umezawa, A.; Miyaba, T.; Tanzawa, T.; Atsumi, S.; Sakui, K., "A CMOS bandgap reference circuit with sub-1-V operation," Solid-State Circuits, IEEE Journal of, vol. 34, No. 5, pp. 670-674, May 1999.*
Widlar, R., "New Developments in IC Voltage Regulators," IEEE Journal of Solid-State Circuits, vol. SC-6, No. 1, Feb. 1971, pp. 2-7.
Kuijk, K., "A Precision Reference Voltage Source," IEEE Journal of Solid-State Circuits, vol. SC-8, No. 3, Jun. 1973, pp. 222-226.
Banba, H., et al "A CMOS Bandgap Reference Circuit with Sub-1-V Operation," IEEE Journal of Solid-State Circuits, vol. 34, No. 5, May 1999, pp. 670-674.

* cited by examiner

*Primary Examiner*—Lincoln Donovan
*Assistant Examiner*—John W Poos
(74) *Attorney, Agent, or Firm*—Slater & Matsil, L.L.P.

(57) ABSTRACT

A system includes a bandgap reference voltage circuit, a plurality of trimming resistors, a plurality of trimming switches to connect the bandgap reference voltage circuit to one or more of the plurality of trimming resistors, and an output terminal to connect to at least one of the bandgap reference voltage circuit and the plurality of trimming resistors. The system may provide a trimmed reference voltage independent of at least one of the resistance of any of the plurality of trimming switches and the voltage across any of the plurality of trimming switches.

33 Claims, 8 Drawing Sheets

SYSTEMS, APPARATUS AND METHODS RELATING TO BANDGAP CIRCUITS

TECHNICAL FIELD

The present invention relates to a circuit for providing a voltage, and relates particularly, though not solely, to a bandgap reference voltage circuit.

BACKGROUND

It is useful in the field of electronic circuits to provide a constant and stable reference voltage. For example reference voltages of around 1.25V are common as this is close to the theoretical bandgap of silicon at 0 K.

An example prior art system that provides a reference voltage is a "bandgap reference voltage circuit". Various methods have been proposed including those by Widlar, R., "New Developments in IC Voltage Regulators," IEEE Journal of Solid-State Circuits, Vol. SC-6, pp. 2-7, February 1971; K. Kuijk, "A Precision Reference Voltage Source," IEEE Journal of Solid-State Circuits, Vol. SC-8, pp. 222-226, June 1973; and H. Banba, et. al., "A CMOS Bandgap Reference Circuit with sub-1-V Operation," IEEE Journal of Solid-State Circuits, Vol. 34, pp. 670-674, May 1999.

BRIEF DESCRIPTION OF THE DRAWINGS

Exemplary embodiments will now be described for the sake of example only with reference to the drawings, in which.

DETAILED DESCRIPTION OF ILLUSTRATIVE EMBODIMENTS

Figure 1A:
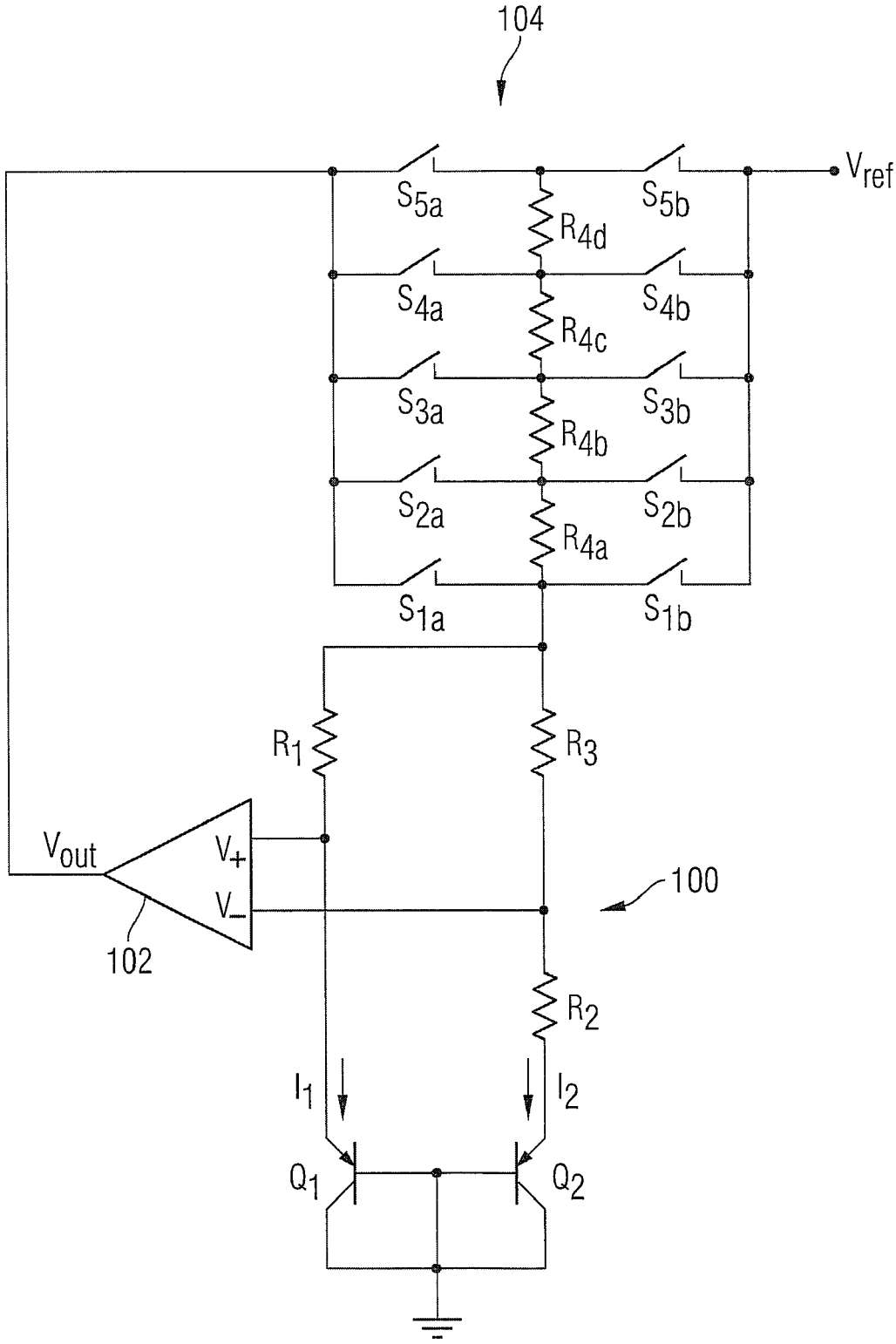
FIGS. 1*a*-1*c* show circuit diagrams of a bandgap circuit with a trimming circuit according to example embodiments.

Referring to FIG. 1*a* a bandgap circuit 100 is shown according to an exemplary embodiment. An operational amplifier OPAMP 102 has a positive input terminal $V_+$ a negative input terminal $V_-$ and an OPAMP output $V_{out}$. A first resistor $R_1$ is connected to the positive input terminal $V_+$. A second resistor $R_2$ is connected to the negative input terminal $V_-$. A third resistor $R_3$ is connected between the negative input terminal $V_-$ and the first resistor $R_1$. A first PNP bipolar transistor $Q_1$ has the emitter connected to the positive input terminal $V_+$, the collector and the base connected to ground, and emitter current $I_1$. A second PNP bipolar transistor $Q_2$ has the emitter connected to the second resistor $R_2$, the collector and the base connected to ground, and emitter current $I_2$. The OPAMP 102 operates to equalize the voltage at its inputs $V_+ - V_- \sim 0V$, as shown in equation 1:

$$I_1 * R_1 = I_2 * R_3 \tag{1}$$

$I_1$ and $I_2$ are the currents through the emitter of each bipolar transistor. $\Delta V_{EB}$ is the difference between $V_{EBQ1}$ and $V_{EBQ2}$, and can be calculated according to equation (2):

$$\begin{aligned} \Delta V_{EB} &= V_{EB1} - V_{EB2} \\ &= I_2 * R_2 \end{aligned} \tag{2}$$

Therefore, the temperature stability of the bandgap circuit output voltage $V_{ref}$ without g (i.e $R_4$=0Ω) may be analyzed using equation (3):

$$\begin{aligned} V_{ref} &= V_{EB1} + I_2 * R_3 \\ &= V_{EB1} + (\Delta V_{EB} / R_2) * R_3 \\ &= V_{EB1} + (R_3 / R_2) * V_t * \mathrm{Ln}[(R_3 / R_1) * (I_{S2} / I_{S1})] \end{aligned} \tag{3}$$

In Equation (3), $V_t$ is the thermal voltage (eg: ~26 mV@ 25° C.) and $I_S$ is the saturation current coefficient of $Q_1$ and $Q_2$. The bandgap circuit may have an operating configuration, for example equal bias currents ($I_1$=$I_2$ $R_1$=$R_3$) and bipolar device ratio scaling ($I_{S2}/I_{S1}$=N) or bias current scaling ($I_1$=N*$I_2$, $R_3/R_1$=N, $I_{S1}$=$I_{S2}$). In those configurations the circuit operation is characterized by Equation (4):

$$V_{ref} = V_{EBQ1} + (R_3/R_2) * V_t * Ln(N) \tag{4}$$

In Equation (4), $V_{BEQ1}$ ("CTAT component") is complementary to absolute temperature (CTAT). As such, the voltage reduces with increasing temperature and has approximate proportionally within small operating temperature ranges. The right hand term in Equation (4) ($R_3/R_2$*$V_t$*Ln(N)) ("PTAT component"), the $V_t$ is proportional to absolute temperature (PTAT) so that the voltage increases with increasing temperature and has approximate proportionally within small operating temperature ranges. Thus, if the ratios between the resistor are appropriately designed, the CTAT component and the PTAT component will cancel each other out over a given temperature range, to achieve high temperature stability of $V_{ref}$ eg: zero temperature coefficient.

In practice the precision or accuracy of bandgap circuits may be limited by manufacturing variations eg: variations in $V_{BE}$, and bipolar and resistor matching.

FIG. 1*a* shows a trimming circuit 104 connected between the output of the OPAMP $V_{out}$ and the common point of $R_1$ and $R_3$. In operation the trimming circuit 104 may provide a predetermined trimming resistance that compensates for the voltage magnitude and/or the temperature coefficient.

The trimming circuit 104 comprises a series of trim resistors $R_{4a}$-$R_{4d}$ connected to the common point between $R_1$ and $R_3$. A series of switch pairs $S_1$-$S_5$ have the first set of switches $S_{1a}$-$S_{5a}$ connected between the output of the OPAMP $V_{out}$ and the trim resistors, and the second set of switches $S_{1b}$-$S_{5b}$ connected between the trim resistors and the output terminal $V_{ref}$.

The trimming of $R_4$ causes an adjustment of the positive temperature coefficient component according to Equation (5):

$$\begin{aligned} V_{ref} &= V_{EB1} + I_2 * R_3 + (I_1 + I_2) * R_4 \\ &= V_{EB1} + I_2 * (R_3 + R_4) + I_1 * R_4 \end{aligned} \tag{5}$$

-continued $$= V_{EB1} + I_2 * (R_3 + R_4) + I_2 * R4 * R_3 / R_1$$

$$= V_{EB1} + I_2 * [R_3 + R_4 * (1 + R_3 / R_1)]$$

$$= V_{EB1} + (\Delta V_{EB} / R_2) * [R_3 + R_4 * (1 + R_3 / R_1)]$$

$$= V_{EB1} + [(R_3 / R_2) + (R_4 / R_2) * \{1 + (R_3 / R_1)\}] * V_t * \mathrm{Ln}(N)$$

In Equation (5), $R_4$ is the value of the resistance between the selected connection point/closed switch and the common point between $R_1$ and $R_3$.

One of the first set of switches $S_{1a}$-$S_{5a}$ will carry the current that flows through $R_4$. These switches are termed current force switches. The current force switches $S_{1a}$-$S_{5a}$ do not affect the output voltage since the switches are not in the sense path of the $V_{ref}$ output terminal. By connecting the output terminal $V_{ref}$ to a high impedance load, any parasitic voltage drop across the second set of switches $S_{1b}$-$S_{5b}$ will be negligible. The second sets of switches are termed the voltage sense switches. The circuit in FIG. 1*a* is configured so that the output voltage $V_{ref}$ is independent of the resistance and/or the voltage drop across any of the current force and voltage sense switches. The circuit in FIG. 1*a* is also configured so that the bipolar bias currents $I_1$ and $I_2$ do not become unmatched by trimming $R_4$. In order to ensure correct performance over the operating range of temperatures, $R_2$ is fixed and $R_1$ and $R_3$ are tracking. The voltage supply to the OPAMP, such as OPAMP 102 in FIG. 1*a*, should provide enough headroom for the voltage drop across the current force switches.

Figure 1B:
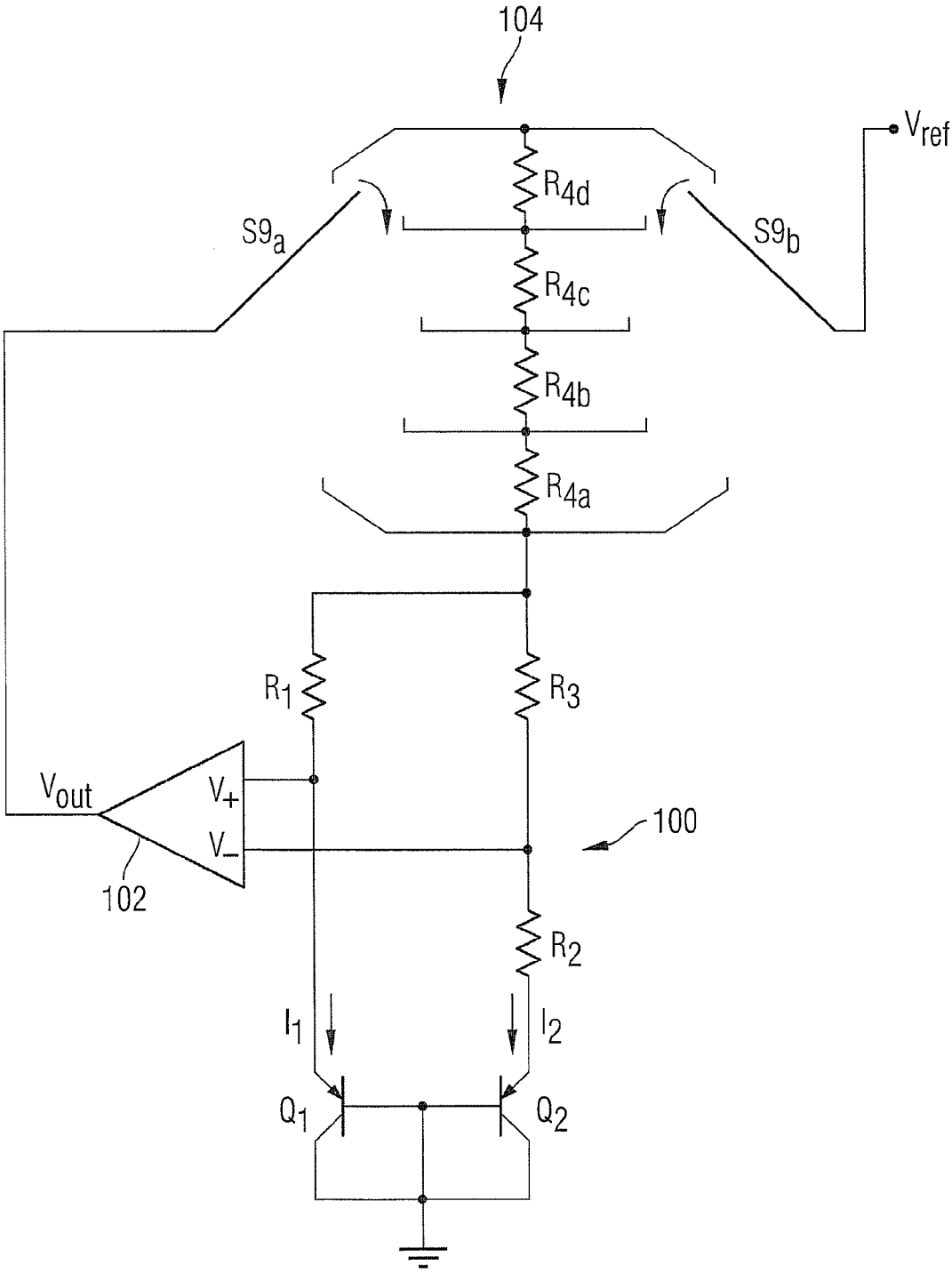
Figure 1C:
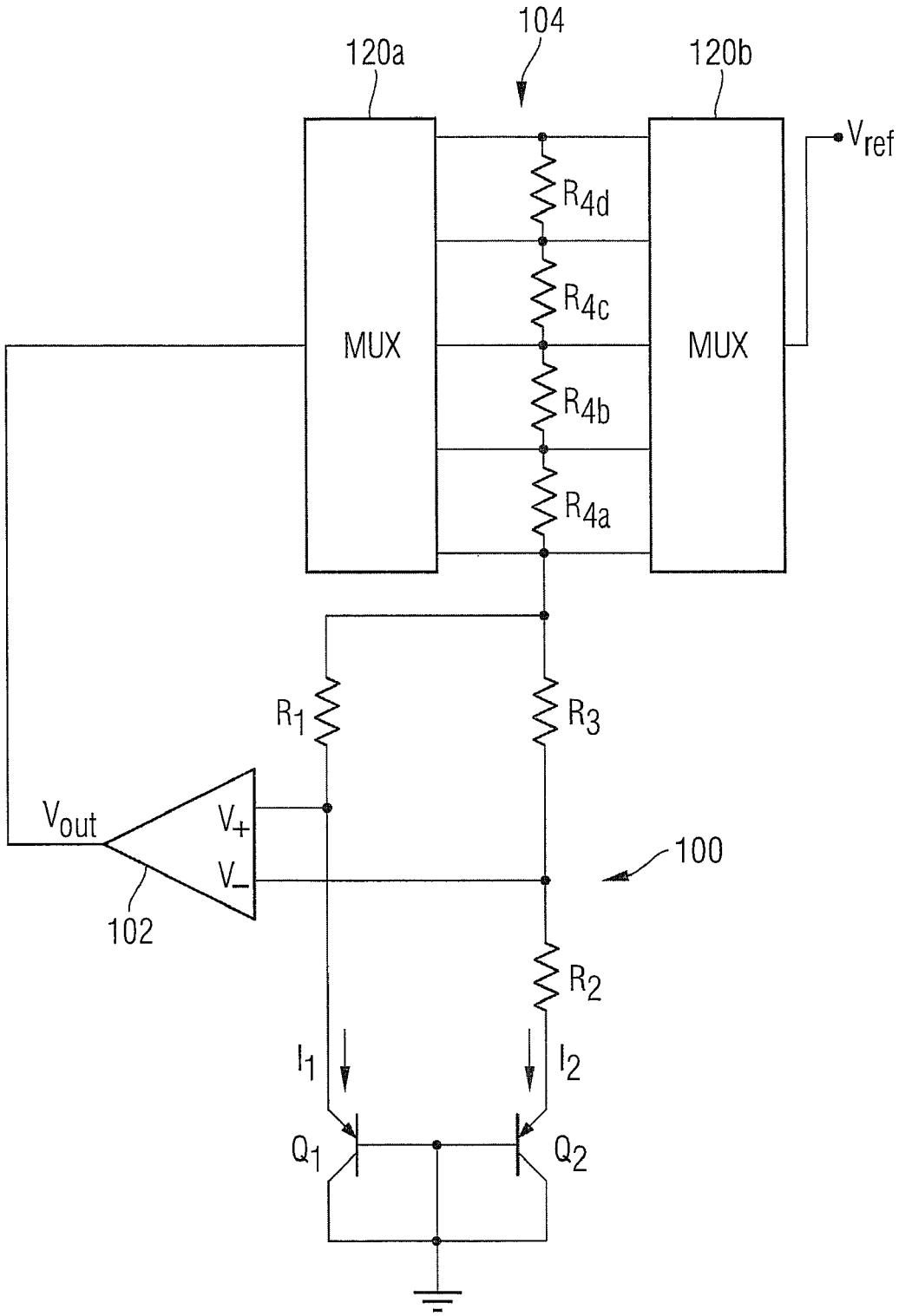

Turning to FIG. 1*b*, an alternative embodiment of the present invention is shown. Switches $S1_a$-$S5_a$ are implemented with multi-way switch $S9_a$ and switches $S1_b$-$S5_b$ are implemented with multi-way switch $S9_b$. Switches $S9_a$ and $S9_b$ can also be implemented as a double-pole multi-way switch. A further alternative embodiment of the present invention is shown in FIG. 1*c*, where switches $S1_a$-$S5_a$ and switches $S1_b$-$S5_b$ are implemented as multiplexers 120*a* and 120*b*, respectively.

Figure 2:
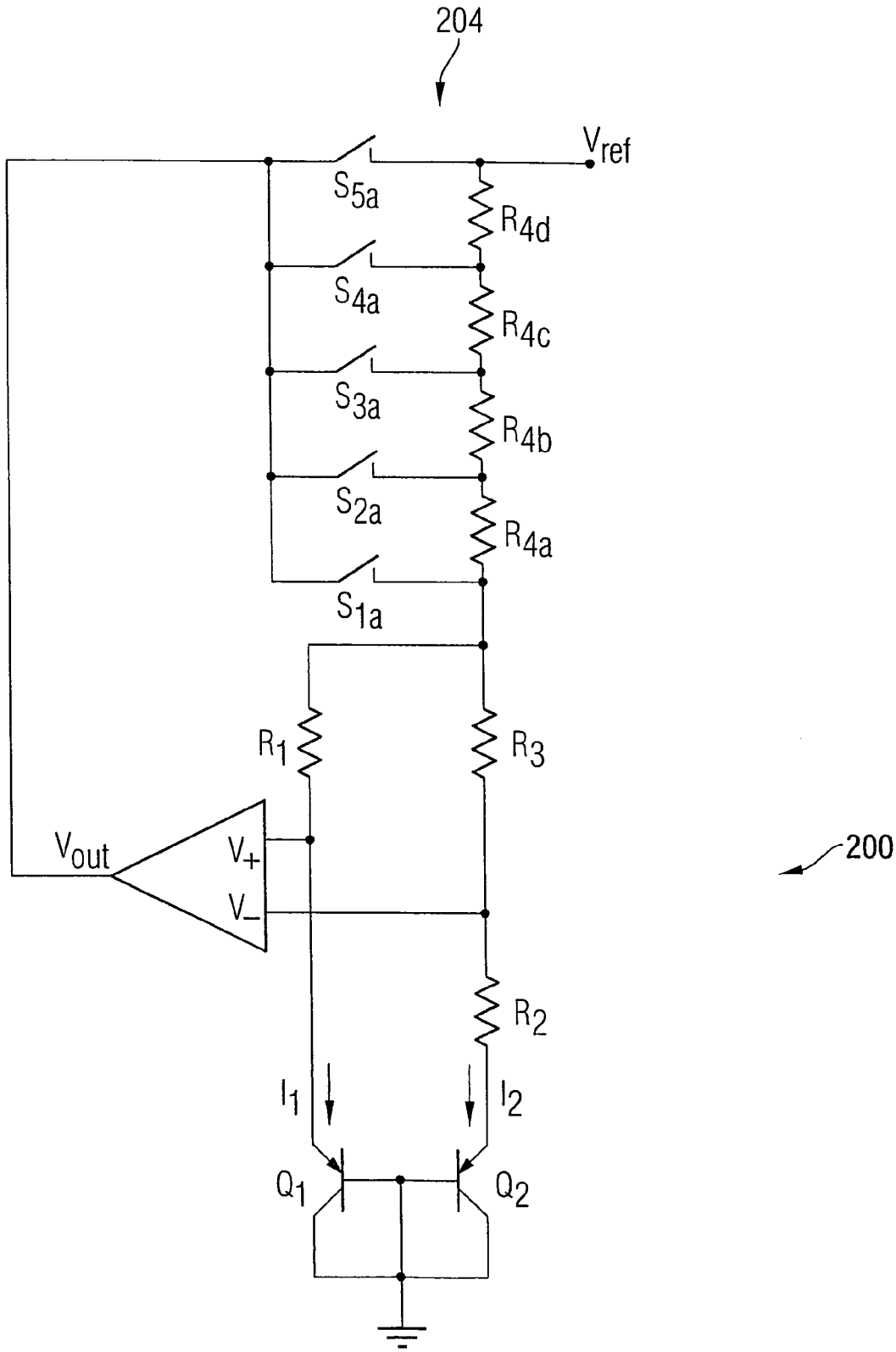
FIG. 2 shows a circuit diagram of a bandgap circuit with a trimming circuit according to a further example embodiment.

Referring to FIG. 2, a bandgap circuit 200 is shown according to a further exemplary embodiment. The bandgap circuit 200 operates similarly to the bandgap circuit 100 shown in FIG. 1*a*. FIG. 2 shows a trimming circuit 204 connected between the output of the OPAMP $V_{out}$ and the common point of $R_1$ and $R_3$. In operation the trimming circuit 204 may provide a predetermined trimming resistance $R_4$ that compensates for the voltage magnitude and/or the temperature coefficient.

The trimming circuit 204 comprises a series of trim resistors $R_{4a}$-$R_{4d}$ connected between the common point between $R_1$ and $R_3$ and the output terminal $V_{ref}$. A series of switches $S_1$-$S_5$ are connected between the output of the OPAMP $V_{out}$ and the trim resistors. By connecting the output terminal $V_{ref}$ to a high impedance load, any parasitic voltage drop across the non current-carrying $R_4$ resistors, between the output terminal $V_{ref}$ and the selected connection point/closed switch, will be negligible. The circuit in FIG. 2 is configured so that the output voltage $V_{ref}$ is independent of the resistance and/or the voltage drop across any of the switches.

Figure 3:
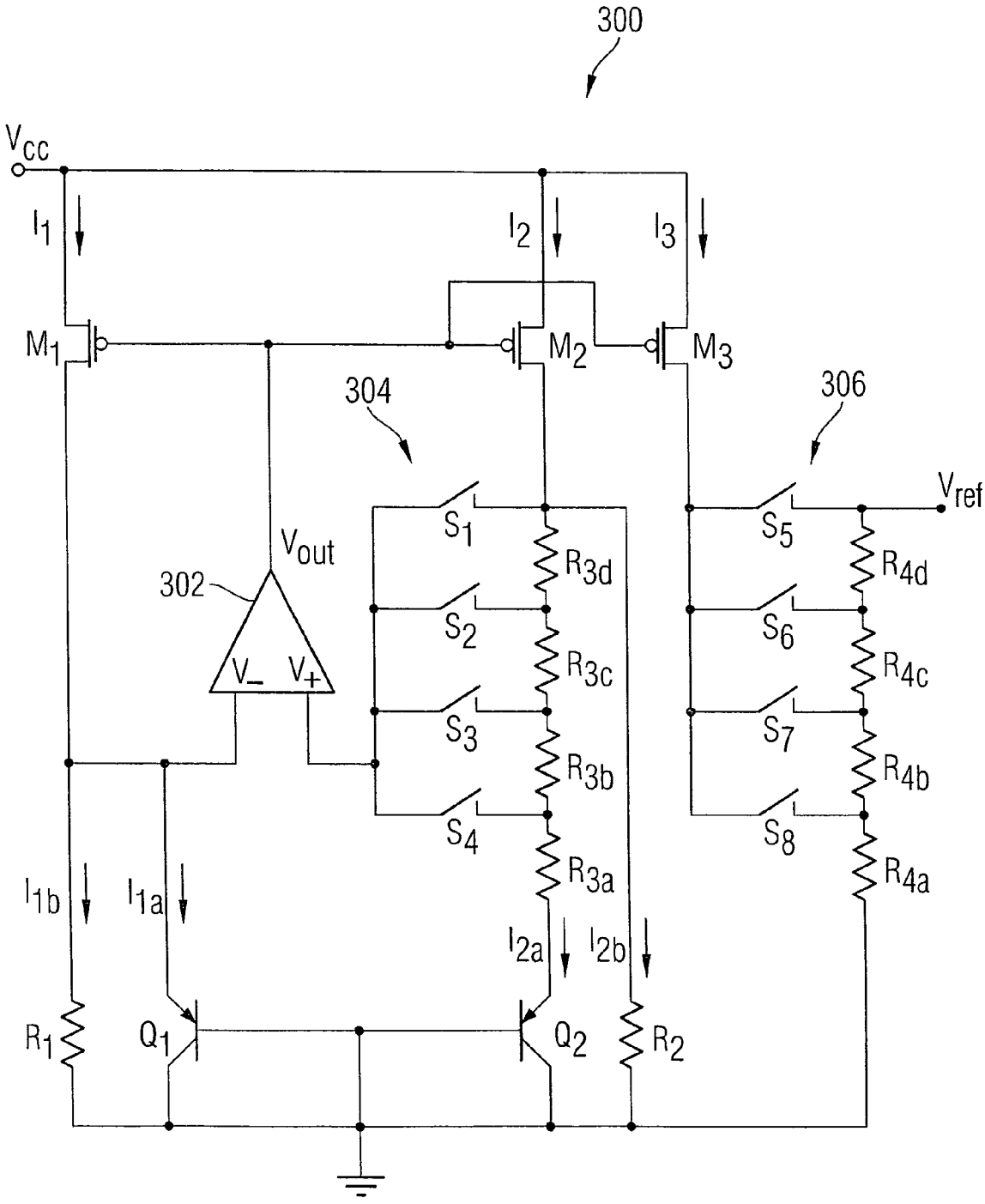
FIG. 3 shows a circuit diagram of a bandgap circuit with a trimming circuit according to a still further example embodiment.

Referring to FIG. 3 a bandgap circuit 300 is shown according to a still further exemplary embodiment. An operational amplifier OPAMP 302 has a positive input terminal $V_+$ a negative input terminal $V_-$ and an OPAMP output $V_{out}$. A first PMOS transistor $M_1$ has its drain terminal connected to the negative input terminal $V_-$, its source terminal connected to a supply $V_{CC}$, its gate terminal connected to the OPAMP output $V_{out}$, and drain current $I_1$. A first resistance $R_1$ is connected to the negative input terminal $V_-$, with resistor current $I_{1b}$. A first PNP bipolar transistor $Q_1$ has its emitter terminal connected to the negative input terminal $V_-$, its collector terminal and its base terminal connected to ground, and emitter current $I_{1a}$. A second PMOS transistor $M_2$ has its source terminal connected to the supply $V_{CC}$, its gate terminal to connect to the OPAMP output $V_{out}$, and drain current $I_2$. A second resistance $R_2$ is connected to the drain terminal of the second PMOS transistor $M_2$ with resistor current $I_{2b}$. A second PNP bipolar transistor $Q_2$ has its emitter terminal connected to the second end of the third plurality of trimming resistors, its collector terminal and its base terminal connected to ground, and an emitter current $I_{2a}$. A third PMOS transistor $M_3$ has its source terminal connected to the supply $V_{CC}$, its gate terminal connected to the OPAMP output $V_{out}$, and a drain current $I_3$.

FIG. 3 shows a first trimming circuit 304 connected between the second PMOS transistor $M_2$ and the OPAMP 302. In operation the trimming circuit 304 may provide a predetermined trimming resistance $R_3$ that compensates for the temperature coefficient.

The first trimming circuit 304 comprises a third plurality of trimming resistors $R_3$ that are connected at a first end to the drain terminal of the second PMOS transistor $M_2$. A first plurality of trimming switches $S_1$-$S_4$ is connected between the positive input terminal $V_+$ and a selected connection point between two of the third plurality of trimming resistors $R_3$.

FIG. 3 shows a second trimming circuit 306 connected between the third PMOS transistor $M_3$ and ground. In operation the trimming circuit 306 may provide a predetermined trimming resistance $R_4$ that compensates for the output voltage magnitude.

The second trimming circuit 306 comprises a fourth plurality of trimming resistors $R_4$ that are connected at a second end to ground. A second plurality of trimming switches $S_5$-$S_8$ are connected between the drain terminal of the third PMOS transistor $M_3$ and a selected connection point between two of the fourth plurality of trimming resistors $R_4$.

An output terminal $V_{ref}$ is connected to the first end of the fourth plurality of trimming resistors $R_4$. The trimming of $R_3$ and/or $R_4$ causes an adjustment of the output voltage $V_{ref}$ according to Equations (6) to (9):

$$\begin{aligned} I_1 &= I_2 = I_3 \\ &= I_{1a} + I_{1b} = I_{2a} + I_{2b} \\ &= \Delta V_{EB2} / R_{3A} + V_{R2} / R_2 \\ &= \Delta V_{EB2} / R_{3A} + [V_{EB1} + I_{2a} * R_{3B}] / R_2 \text{ where } R_2 = R_1 \\ &= \Delta V_{EB2} / R_{3A} + [V_{EB1} + \{\Delta V_{EB2} / R_{3A}\} * R_{3B}] / R_1 \\ &= (V_{EB1} + \Delta V_{EB2} * [R_1 / R_{3A}] * \{1 + R_{3B} / R_1\}) / R_1 \\ &= (V_{EB1} + [R_1 / R_{3A}] * \{1 + R_{3B} / R_1\} * V_t * \mathrm{Ln} \\ &\quad [(I_{1a}) / (I_{2a}) * (Is_2 / Is_1)]) / R1 \end{aligned} \tag{6}$$

$$I_{2a} = \Delta V_{EB} / R_{3A} \tag{7}$$

$$\begin{aligned} I_{1a} &= I_1 - I_{1b} \\ &= I_1 - V_{EB1} / R_1 \\ &= (V_{EB1} + \Delta V_{EB2} * [R_1 / R_{3A}] * \{1 + R_{3B} / R_1\}) / R_1 - V_{EB1} / R_1 \\ &= (1 + R_{3B} / R_1) * \Delta V_{EB2} / R_{3A} \\ &= (1 + R_{3B} / R_1) * I_{2a} \end{aligned} \tag{8}$$

In Equation (8) the bipolar transistors $Q_1$ and $Q_2$ have PTAT bias currents. In Equations (6) to (9) $R_{3A}$ is the value of the resistance between selected connected point/closed switch $S_1$-$S_4$ and the second PNP bipolar transistor $Q_2$, and $R_{3B}$ is the value of the resistance between selected connected point/closed switch $S_1$-$S_4$ and the second PMOS transistor $M_2$. In Equation (6) $V_{R2}$ is the voltage across the second resistor $R_2$. $I_1$-$I_3$ are the currents through each of the PMOS transistors. $I_{1a}$ and $I_{2a}$ are the currents through the bipolar transistors, and $I_{1b}$ and $I_{2b}$ are the currents through $R_1$ and $R_2$ respectively.

$$\begin{aligned} V_{ref} &= I_3 * R_4 \qquad (9) \\ &= (V_{EB1}(I_1) + [R_1/R_{3A}] * \{1 + R_{3B}/R_1\} * V_t * \mathrm{Ln}[(I_{1a})/ \\ &\quad (I_{2a}) * (Is_2/Is_1)]) * R_4/R_1 \\ &= (V_{EB1}(I_1) + [R_1/R_{3A}] * \{1 + R_{3B}/R_1\} * V_t * \mathrm{Ln} \\ &\quad [(1 + R_{3B}/R_1) * (Is_2/Is_1)]) * R_4/R_1 \end{aligned}$$

In Equation (9) $V_t$ is the thermal voltage (26 mV@ 25C), $I_S$ is the saturation current coefficient of the bipolar devices $Q_1$ and $Q_2$, The PMOS transistors $M_1$-$M_3$ may have long channel lengths or an output impedance boost to minimize current differences $I_1$-$I_3$ due to different drain voltages and early voltage modulation effect.

According to Equation (9), switches $S_1$-$S_4$ trim the ratios $R_1/R_{3A}$ and $R_{3B}/R_1$ to compensate for the temperature coefficient. By connecting switches $S_1$-$S_4$ to high impedance OPAMP input there would be negligible parasitic voltage drop across the switches $S_1$-$S_4$.

Switches $S_5$-$S_8$ trim the ratio $R_4/R_1$ to compensate the magnitude of the output voltage $V_{ref}$. Switches $S_5$-$S_8$ do not affect the output voltage since the switches are not in the sense path of the $V_{ref}$ output terminal. The voltage drop across the switches $S_5$-$S_8$ will not affect the output voltage as long as there is enough supply voltage headroom.

By connecting the output terminal $V_{ref}$ to a high impedance load, any parasitic voltage drop across the portions of $R_4$ between the output terminal $V_{ref}$ and the closed switch $S_5$-$S_8$ will be negligible. The circuit in FIG. 3 is configured so that the output voltage $V_{ref}$ is independent of the resistance and/or the voltage drop across the switches.

Any other errors in the circuit may be compensated for as is known in the art for example OPAMP offset may be handled by chopping.

A possible application for one or more embodiments is in a CMOS circuit. However it will be readily appreciated by the skilled reader that alternative applications are possible. Equally the skilled reader will appreciate the number of resistor sections and/or switches in each trim circuit can be tailored for the application.

The above example embodiments may be manufactured using fabrication techniques appropriate to the application. The trimming process in each case may occur at manufacturing for each circuit. Once the trimming has been completed the desired switch states may be stored in a Read Only Memory (ROM) or may be permanently set using fuses.

Figure 4:
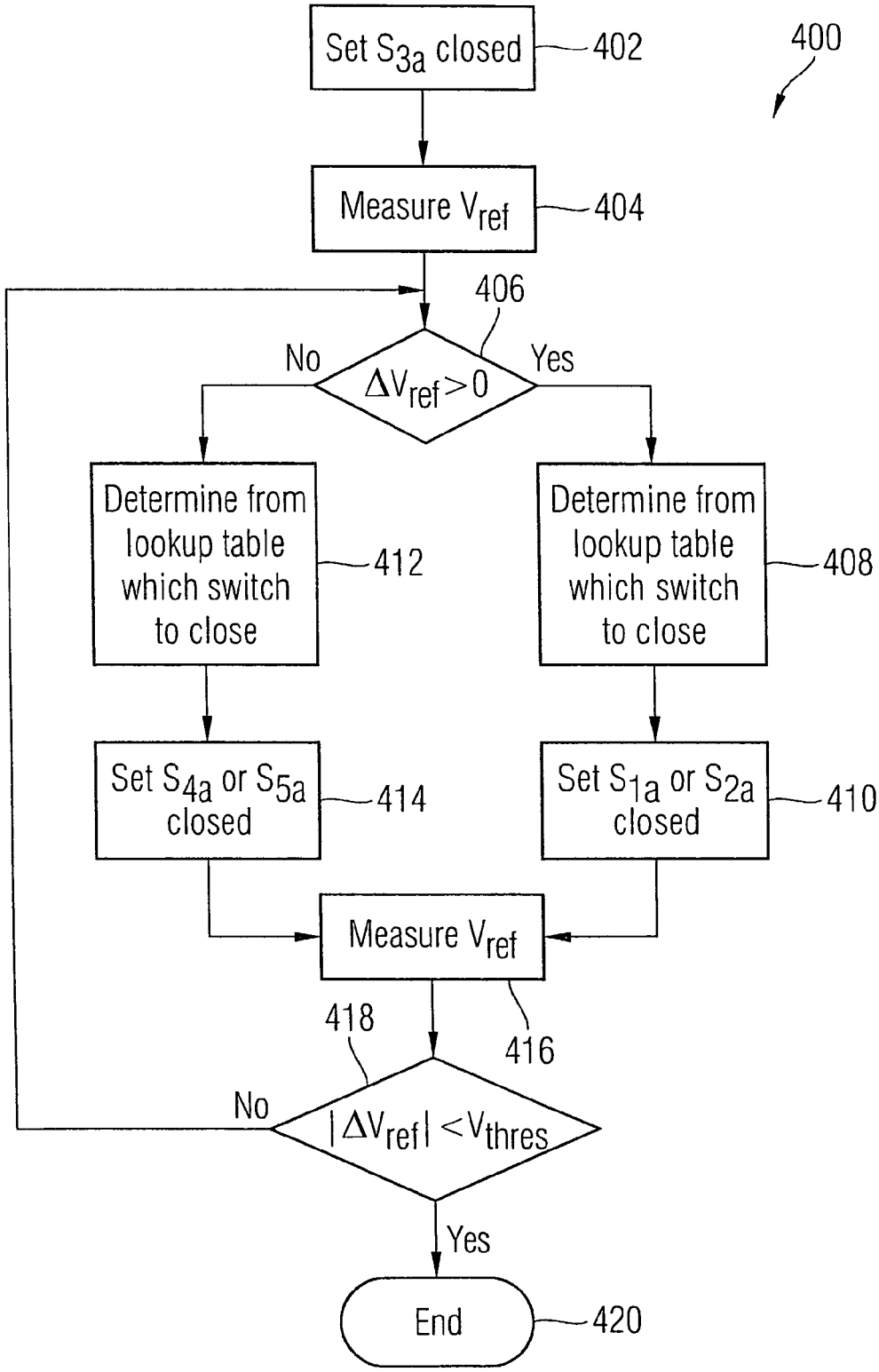
FIG. 4 shows a flow diagram for a method of trimming $R_4$ in FIG. 1*a* or FIG. 2.

Referring to FIG. 4 an example method 400 of trimming $R_4$ is shown, which may be employed during manufacturing of the example embodiment shown in FIG. 1*a* or FIG. 2. The initially closed switch is near the middle of the trim range eg: $S_{3a}$ (402). The output voltage $V_{ref}$ is measured (404). Based on the deviation $\Delta V_{ref}$ of the measured voltage $V_{ref}$ from the desired voltage $V_{des}$ ($\Delta V_{ref}=V_{ref}-V_{des}$) (406), a look up table (408, 412) is used to select the correct trim switch to close (410, 414). The output voltage is again measured (416) and if it is within a threshold range $V_{des}\pm V_{thres}$ around the desired voltage (418), then the trimming process stops (420), otherwise the process is repeated.

Figure 5:
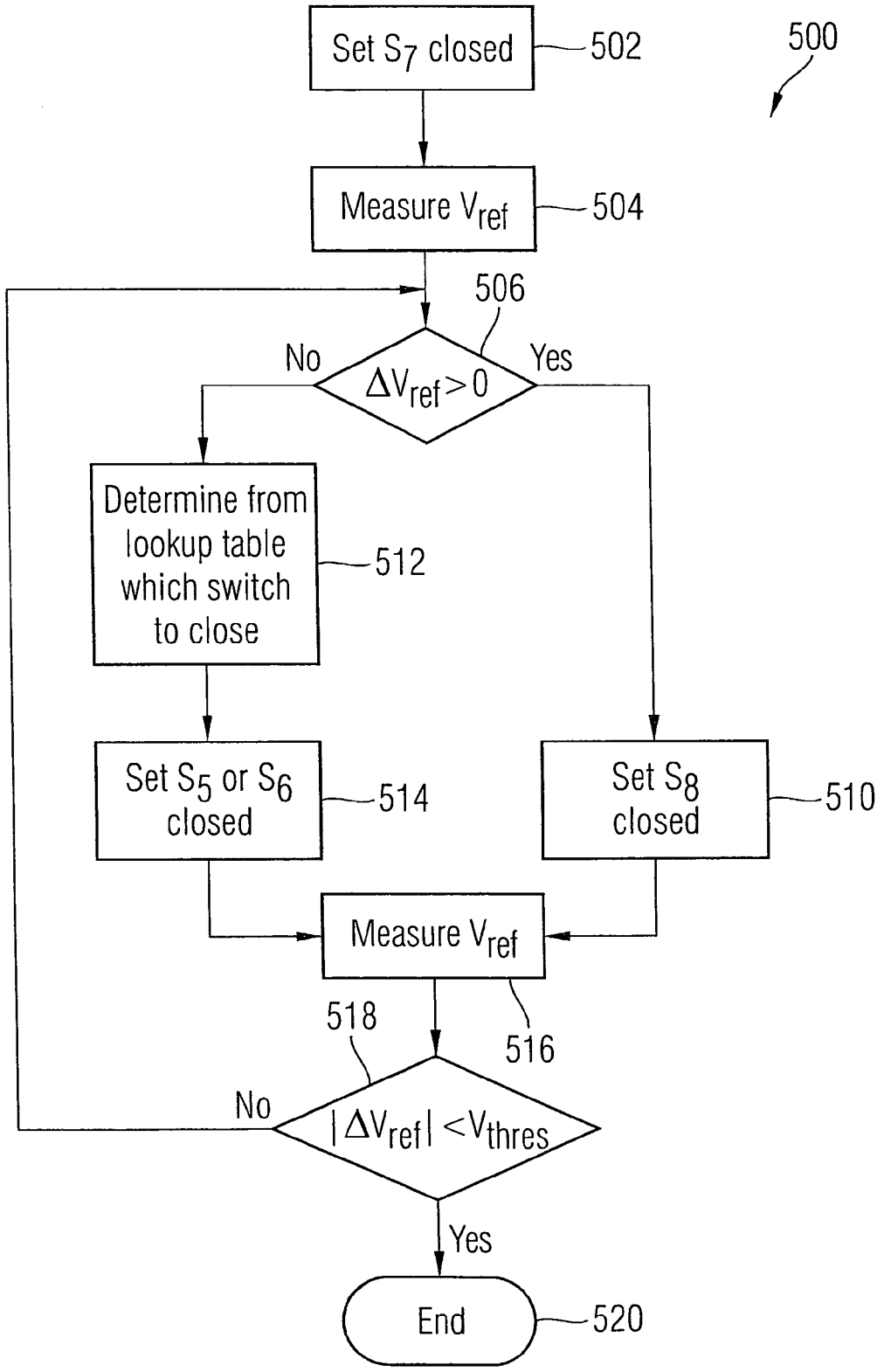
FIG. 5 shows a flow diagram for a method of trimming $R_4$ in FIG. 3.

Referring to FIG. 5 an example method 500 of trimming $R_4$ is shown, which may be employed during manufacturing of the example embodiment shown in FIG. 3. The initially closed switch is near the middle of the trim range eg: $S_7$ (502). The output voltage $V_{ref}$ is measured (504). Based on the deviation $\Delta V_{ref}$ of the measured voltage $V_{ref}$ from the desired voltage $V_{des}$ ($\Delta V_{ref}=V_{ref}-V_{des}$) (506), a look up table (512) is used to select the correct trim switch to close (510, 514). The output voltage is again measured (516) and if it is within a threshold range $V_{des}\pm V_{thres}$ around the desired voltage (518), then the trimming process stops (520), otherwise the process is repeated.

Figure 6:
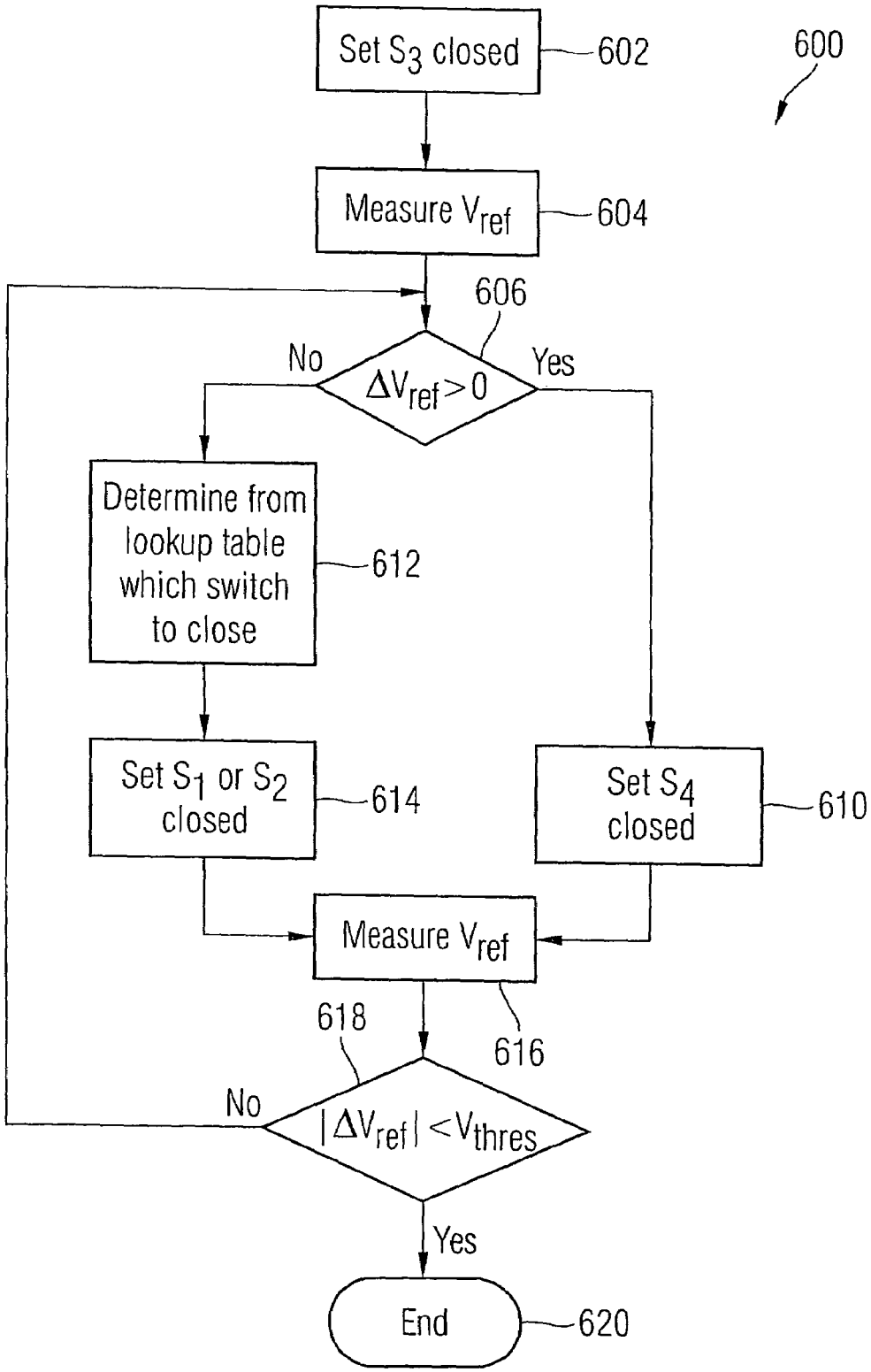
FIG. 6 shows a flow diagram for a method of trimming $R_3$ in FIG. 3.

Referring to FIG. 6 an example method 600 of trimming $R_3$ is shown, which may be employed during manufacturing of the example embodiment shown in FIG. 3. The initially closed switch is near the middle of the trim range eg: $S_3$ (602). The output voltage $V_{ref}$ is measured (604). Based on the deviation $\Delta V_{ref}$ of the measured voltage $V_{ref}$ from the desired voltage $V_{des}$ ($\Delta V_{ref}=V_{ref}-V_{des}$) (606), a look up table (612) is used to select the correct trim switch to close (610, 614). The output voltage is again measured (616) and if it is within a threshold range $V_{des}\pm V_{thres}$ around the desired voltage (618), then the trimming process stops (620), otherwise the process is repeated.

Many variations of the above example embodiments, are possible within the scope of the following claims, as will be clear to a skilled reader.

What is claimed is:

1. An apparatus comprising a bandgap reference voltage generator comprising:

a plurality of trimming resistors coupled in series;

a first plurality of trimming switches to couple a first bandgap terminal to a selected connection point between two of the plurality of trimming resistors to adjust the reference voltage, wherein said first plurality of trimming switches comprises at least one of a multi-way switch or a multiplexer; and an output terminal coupled in series with the selected connection point and configured to provide a trimmed reference voltage a second plurality of trimming switches to coupled between the selected connected point and the output terminal.

2. The apparatus in claim 1, wherein the plurality of trimming resistors have a first end and a second end, the first end being coupled to a second bandgap terminal.

3. The apparatus in claim 2, wherein the output terminal is coupled to the second end.

4. The apparatus in claim 1, wherein the plurality of trimming resistors have a first end and a second end, the first end being coupled to ground.

5. The apparatus in claim 4, wherein the output terminal is coupled to the second end.

6. The apparatus of claim 1, further comprising a CMOS circuit.

7. An apparatus comprising a bandgap reference voltage generator comprising:

a plurality of trimming resistors coupled in series;

a first plurality of trimming switches to couple a first bandgap terminal to a selected connection point between two of the plurality of trimming resistors to adjust the reference voltage; and an output terminal coupled in series with the selected connection point and configured to provide a trimmed reference voltage;

a second plurality of trimming switches to couple between the selected connection point and the output terminal, wherein the plurality of trimming resistors have a first end and a second end, the first end being coupled to a second bandgap terminal, and said first plurality of trimming switches and said second plurality of trimming switches comprise at least one of a double pole multi-way switch or a pair of multiplexers configured to be synchronized.

8. An apparatus comprising:

an operational amplifier having a positive input terminal, a negative input terminal and an OPAMP output;

a first resistance coupled to the positive input terminal;

a second resistance coupled to the negative input terminal;

a third resistance coupled between the negative input terminal and the first resistance;

a first PNP bipolar transistor having a first collector, first emitter and first base, the first emitter coupled to the positive input terminal, the first collector and the first base coupled to ground;

a second PNP bipolar transistor having a second collector, second emitter and second base, the second emitter coupled to the second resistance, the second collector and the second base coupled to ground; and a fourth resistance coupled between the OPAMP output, and the first and third resistance.

9. The apparatus claimed in claim 8, wherein the fourth resistance comprises a first plurality of trimming resistors, having a first end and a second end, the first end being coupled to the first and third resistance, the apparatus further comprising a first plurality of trimming switches to couple the OPAMP output to a selected connection point between two of the plurality of trimming resistors.

10. The apparatus claimed in claim 9, further comprising:

an output terminal to provide a reference voltage, and a second plurality of trimming switches coupled between the selected connection point and the output terminal.

11. The apparatus claimed in claim 9, further comprising:

an output terminal to provide a reference voltage and coupled to said second end.

12. An apparatus comprising:

an operational amplifier having a positive input terminal, a negative input terminal and an OPAMP output;

a first PMOS transistor having a first drain, a first source and a first gate, the first drain coupled to the negative input terminal, the first source coupled to a supply, and the first gate coupled to the OPAMP output;

a first resistance coupled to the negative input terminal;

a first PNP bipolar transistor having a first collector, a first emitter and a first base, the first emitter coupled to the negative input terminal, the first collector and the first base coupled to ground;

a second PMOS transistor having a second drain, a second source and a second gate, the second source coupled to the supply and the second gate coupled to the OPAMP output;

a second resistance coupled to the second drain;

a third plurality of trimming resistors having a first end and a second end, the first end of the third plurality of trimming resistors coupled to the second drain;

a first plurality of trimming switches to couple the positive input terminal to a selected connection point between two of the third plurality of trimming resistors;

a second PNP bipolar transistor having a second collector, a second emitter and a second base, the second emitter coupled to the second end of the third plurality of trimming resistors, the second collector and the second base coupled to ground;

a third PMOS transistor having a third drain, a third source and a third gate, the third source coupled to the supply and the third gate coupled to the OPAMP output;

a fourth plurality of trimming resistors having a first end and a second end, the second end of the fourth plurality of trimming resistors coupled to ground;

a second plurality of trimming switches to couple the third drain to a selected connection point between two of the fourth plurality of trimming resistors; and an output terminal coupled to the first end of the fourth plurality of trimming resistors and provide a reference voltage.

13. The apparatus of claim 12, wherein the first and second plurality of trimming switches are configured to adjust the reference voltage.

14. The apparatus of claim 12, wherein the reference voltage is independent of a resistance of each of the third plurality of trimming resistors.

15. The apparatus of claim 12, wherein:

the first plurality of trimming switches are configured to adjust a temperature coefficient of the reference voltage, and the second plurality of trimming switches are configured to adjust a magnitude of the reference voltage.

16. A method comprising:

providing a voltage reference circuit comprising an amplifier having a first input terminal, a second input terminal and an output, a first resistance coupled to the first input terminal, a second resistance coupled to the second input terminal, a third resistance coupled between the second input terminal and the first resistance, a first transistor coupled between the first input terminal of the amplifier and a supply node, the first transistor having a first terminal, a second terminal and a third terminal, wherein the first terminal of the first transistor is coupled to the third terminal, a second transistor coupled between the second resistance and a supply node, the second transistor having a first terminal, a second terminal and a third terminal, wherein the first terminal of the second transistor is coupled to the third terminal, and an output terminal; and selecting trim resistors to couple between the amplifier output, the first and third resistance, and the output terminal to trim the voltage at the output terminal.

17. A voltage reference comprising:

an amplifier having a first input terminal, a second input terminal and an output;

a first resistance coupled to the first input terminal;

a second resistance coupled to the second input terminal;

a third resistance coupled between the second input terminal and the first resistance;

a first transistor coupled between the first input terminal of the amplifier and a supply node, the first transistor having a first terminal, a second terminal and a third terminal, wherein the first terminal of the first transistor is coupled to the third terminal;

a second transistor coupled between the second resistance and a supply node, the second transistor having a first terminal, a second terminal and a third terminal, wherein the first terminal of the second transistor is coupled to the third terminal; and a fourth resistance coupled between the output of the amplifier and the first and third resistance.

18. The voltage reference claimed in claim 17, wherein:

the fourth resistance comprises a first plurality of trimming resistors, having a first end and a second end, the first end being coupled to the first and third resistance; and the voltage reference further comprises a first plurality of trimming switches to couple the amplifier output to a selected connection point between two of the plurality of trimming resistors.

19. The voltage reference claimed in claim 18, wherein the amplifier comprises an OPAMP.

20. The voltage reference claimed in claim 19, wherein the first input terminal of the amplifier comprises a positive input terminal, and the second input terminal of the amplifier comprises a negative input terminal.

21. The voltage reference claimed in claim 18, wherein:

the first and second transistor comprise bipolar transistors;

the first terminals of the first and second transistors comprise collectors;

the second terminals of the first and second transistors comprise emitters; and the third terminals of the first and second transistors comprise bases.

22. The voltage reference claimed in claim 21, wherein the bipolar transistor comprises a PNP device.

23. The voltage reference claimed in claim 18, wherein the supply node comprises a ground node.

24. A voltage reference comprising:

an amplifier having a first input terminal, a second input terminal and an output;

a first transistor having a first terminal, a second terminal, and a third terminal, the first terminal coupled to the second input terminal of the amplifier, the second terminal coupled to a first supply, and the third terminal coupled to the output of the amplifier;

a first resistance coupled to the second input terminal;

a second transistor coupled between the second terminal of the amplifier and a second supply, the second transistor having a first terminal, a second terminal, and a third terminal, wherein first terminal of the second transistor is coupled to the third terminal of the second transistor;

a third transistor having a first terminal, a second terminal, and a third terminal, the second terminal of the third transistor coupled to the first supply and the third terminal of the third transistor coupled to the output of the amplifier;

a second resistance coupled to the first terminal of the third transistor;

a first plurality of trimming resistors having a first end and a second end, the first end of the first plurality of trimming resistors coupled to the first terminal of the third transistor;

a first plurality of trimming switches to couple the first input terminal of the amplifier to a selected connection point between two of the first plurality of trimming resistors;

a fourth transistor coupled between the second end of the first plurality of trimming resistors and the second supply, the fourth transistor having a first terminal, a second terminal, and a third terminal, wherein the first terminal of the fourth transistor is coupled to the third terminal of the fourth transistor;

a fifth transistor having a first terminal, a second terminal, and a third terminal, the second terminal of the fifth transistor coupled to the first supply and the third terminal of the fifth transistor coupled to the output of the amplifier;

a third resistance coupled between the first terminal of the fifth transistor and the second supply; and an output terminal coupled to the first terminal of the fifth transistor to provide a reference voltage.

25. The voltage reference of claim 24, wherein:

the first, third and fifth transistors comprise MOS transistors;

the first terminals of the first, third and fifth transistors comprise drains;

the second terminals of first, third and fifth transistors comprise sources; and the third terminals of first, third and fifth transistors comprise gates.

26. The voltage reference of claim 25, wherein the MOS transistors comprise PMOS transistors.

27. The voltage reference of claim 24, wherein:

the second and fourth transistors comprise bipolar transistors;

the first terminals of the second and fourth transistors comprise collectors;

the second terminals of the second and fourth transistors comprise emitters; and the third terminals of the second and fourth transistors comprise bases.

28. The voltage reference of claim 27, wherein the bipolar transistors comprise PNP transistors.

29. The voltage reference of claim 28, wherein the second supply comprises ground.

30. The voltage reference of claim 24, wherein the third resistance comprises:

a second plurality of trimming resistors having a first end and a second end, the second end of the second plurality of trimming resistors coupled to the second supply; and a second plurality of trimming switches to couple the first terminal of the fifth transistor to a selected connection point between two of the second plurality of trimming resistors.

31. A method comprising:

providing a voltage reference circuit comprising:

an amplifier having a first input terminal, a second input terminal and an output;

a first transistor having a first terminal, a second terminal, and a third terminal, the first terminal coupled to the second input terminal of the amplifier, the second terminal coupled to a first supply, and the third terminal coupled to the output of the amplifier;

a first resistance coupled to the second input terminal;

a second transistor coupled between the second terminal of the amplifier and a second supply, the second transistor having a first terminal, a second terminal, and a third terminal, wherein first terminal of the second transistor is coupled to the third terminal of the second transistor;

a third transistor having a first terminal, a second terminal, and a third terminal, the second terminal of the third transistor coupled to the first supply and the third terminal of the third transistor coupled to the output of the amplifier;

a second resistance coupled to the first terminal of the third transistor;

a fourth transistor coupled to the second supply, the fourth transistor having a first terminal, a second terminal, and a third terminal, wherein the first terminal of the fourth transistor is coupled to the third terminal of the fourth transistor;

a fifth transistor having a first terminal, a second terminal, and a third terminal, the second terminal of the fifth transistor coupled to the first supply and the third terminal of the fifth transistor coupled to the output of the amplifier;

a third resistance to couple between the first terminal of the fifth transistor and the second supply; and an output terminal coupled to the first terminal of the fifth transistor to provide a reference voltage, selecting from a first plurality of trim resistors to couple between the first terminal of the third transistor, the first input terminal of the amplifier and the fourth transistor to trim the voltage at the output terminal.

32. The method of claim 31, wherein:

the third resistance comprises a second plurality of trim resistors; and the method further comprises selecting from the second plurality of trim resistors to trim the voltage at the output terminal.

33. The method of claim 31, wherein selecting from the first plurality of trim resistors adjusts a temperature coefficient of the voltage at the output terminal.

* * * * *